United States Patent [19]

Morikawa

[11] Patent Number: 5,022,367

[45] Date of Patent: Jun. 11, 1991

[54] ENGINE BRAKE SYSTEM OF A TWO-CYCLE ENGINE FOR A MOTOR VEHICLE

[75] Inventor: Koji Morikawa, Musashino, Japan

[73] Assignee: Fuji Jukogyo Kabushiki Kaisha, Tokyo, Japan

[21] Appl. No.: 562,485

[22] Filed: Aug. 3, 1990

[30] Foreign Application Priority Data

Aug. 29, 1989 [JP] Japan ..... 1-222704

[51] Int. Cl.[5] ..... F02D 9/06

[52] U.S. Cl. ..... 123/324; 123/65 BA

[58] Field of Search ..... 123/324, 320, 65 BA, 123/65 B

[56] References Cited

U.S. PATENT DOCUMENTS

| | | | |
|---|---|---|---|
| 1,990,565 | 2/1935 | Phillips | 123/65 B |
| 2,489,540 | 11/1949 | Priess | 123/65 B |
| 2,891,524 | 6/1959 | Scheitarlein | 123/65 BA |
| 3,036,561 | 5/1962 | Barchtold | 123/65 B |
| 3,540,421 | 11/1970 | Boyce, Jr. | 123/65 BA |
| 3,906,909 | 9/1975 | Garcea | 123/234 |
| 4,162,662 | 7/1979 | Melchior | 123/65 BA |
| 4,289,094 | 9/1981 | Tanahashi | 123/324 |
| 4,445,468 | 5/1984 | Onishi et al. | 123/324 |

FOREIGN PATENT DOCUMENTS

| | | | |
|---|---|---|---|
| 61-272425 | 12/1986 | Japan | 123/324 |

*Primary Examiner*—Raymond A. Nelli

*Attorney, Agent, or Firm*—Martin A. Farber

[57] ABSTRACT

A two-stroke engine has a scavenge pump provided in an intake passage. A valve is provided in the intake passage downstream of the scavenge pump. When deceleration of a vehicle is detected, the valve is operated to partially close the intake passage.

6 Claims, 7 Drawing Sheets

ENGINE BRAKE SYSTEM OF A TWO-CYCLE ENGINE FOR A MOTOR VEHICLE

BACKGROUND OF THE INVENTION

The present invention relates to an engine brake system of a two-cycle engine, and more particularly to a system for increasing an engine braking effect of the two-cycle engine.

In order to increase the engine braking effect of a four-cycle diesel engine, a butterfly valve is provided in an exhaust passage. However, the butterfly valve having movable portions is not proper for using in the exhaust passage, because it is exposed to high temperature.

The two-cycle engine inherently has low pumping loss compared to the four-cycle engine, because the two-stroke cycle of the two-cycle engine completes four cycles with one revolution of a crankshaft. Consequently, a vehicle driven by the two-cycle engine has a small engine braking effect.

Japanese Patent Application Laid-Open 61-272425 discloses a two-stroke engine having a system for increasing the braking effect of the two-cycle engine. The two-cycle engine has a connecting passage for communicating a combustion chamber with an exhaust passage in parallel with the exhaust passage. The connecting passage has a rotary valve for communicating the combustion chamber with atmosphere through the exhaust passage. An opening area of the rotary valve changes in accordance with engine speed. When a throttle valve of the engine is further rotated from an idling position to a more closing position by turning a control grip on a steering bar of a motor cycle, the rotary valve is opened to communicate the combustion chamber with the atmosphere. Thus, gas in the chamber flows alternately passing through the valve in accordance with the reciprocation of a piston, generating resistance against the piston of the engine to increase the engine braking effect.

However, the engine braking effect is not sufficiently increased.

SUMMARY OF THE INVENTION

The object of the present invention is to provide a two-cycle engine with a scavenge pump where an engine brake may be effectively increased.

There has been proposed an use of a scavenge pump for a two-cycle engine. In such a system, an engine braking effect can be increased, if load on a scavenge pump is increased. In the present invention, the scavenge pump is utilized for increasing the engine braking effect.

According to the present invention, there is provided an engine brake system of a two-cycle engine for a motor vehicle, the engine having at least one cylinder, a scavenge port, an intake passage communicated with the scavenge port, and a scavenge pump provided in the intake passage and driven by a crankshaft of the engine for supplying intake air to the cylinder.

The system comprises an engine brake valve provided in the intake passage adjacent the scavenge pump, an actuator for operating the engine brake valve, detector means for detecting deceleration of the vehicle and for producing a deceleration signal, means responsive to the deceleration signal for operating the actuator for closing the engine brake valve so as to increase load on the engine.

In an aspect of the invention, the actuator has a diaphragm operated by a pressure applied to one side thereof from the intake passage adjacent the engine brake valve, and is arranged such that the diaphragm is kept at a position where the pressure balances with another pressure applied to the other side thereof.

These and other objects and features of this invention will become understood from the following description with reference to the accompanying drawings.

DETAILED DESCRIPTION OF THE PREFERRED EMBODIMENTS

Figure 1A:
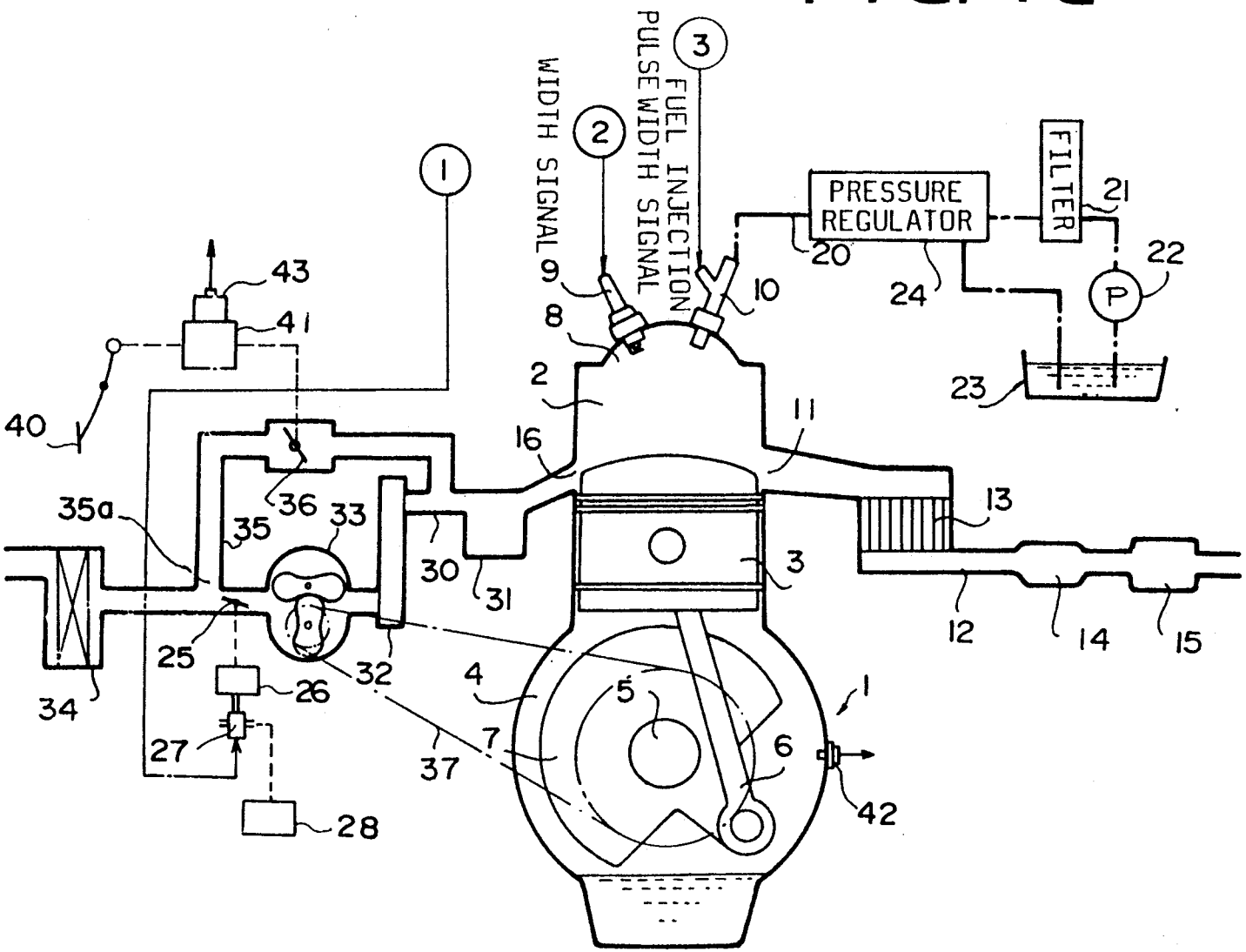
FIGS. 1*a* and 1*b* show a schematic diagram of a two-cycle engine of the present invention.
Figure 1B:
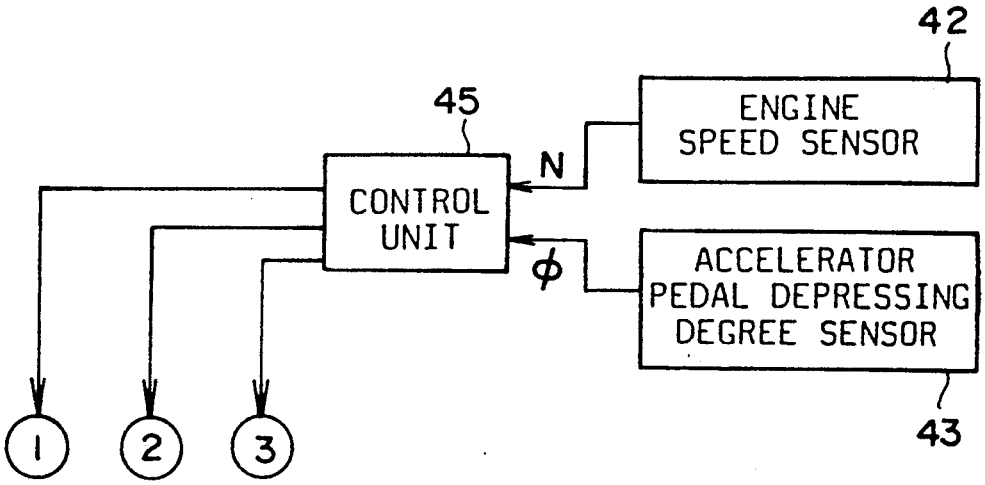

Referring to FIGS. 1*a* and 1*b*, a two-cycle engine 1 for a motor vehicle comprises a cylinder 2, a piston 3 provided in the cylinder 2, a connecting rod 6 connected with the piston 3 and a crankshaft 5 disposed in a crankcase 4. A counterweight 7 is mounted on the crankshaft 5 so as to reduce inertia of the piston 3 reciprocating in the cylinder 2.

In a wall of the cylinder 2, an exhaust port 11 and a scavenge port 16 are formed in 90 degrees angular disposition or opposing one another. The ports 11 and 16 are adapted to open at a predetermined timing with respect to a position of the piston 3.

A fuel injector 10 and a spark plug 9 are provided at a top of a combustion chamber 8 of the cylinder 2. The injector 10 is a type where a predetermined amount of fuel is injected. Fuel in a fuel tank 23 is supplied to the injector 10 through a fuel passage 20 having a filter 21, a pump 22 and a pressure regulator 24 for constantly maintaining the fuel at a predetermined high fuel pressure.

The engine 1 is supplied with air through an air cleaner 34, a displacement scavenge pump 33, an intercooler 32 for cooling scavenge air, an intake pipe 30 having a scavenge chamber 31 for absorbing scavenge pressure waves when the scavenge port 16 is opened or closed. A bypass 35 is provided around the scavenge pump 33 and the intercooler 32. The bypass 35 is provided with a control valve 36 for controlling the load on the engine 1. An engine brake control valve 25 is provided in the intake pipe 30 between the scavenge pump 33 and a junction 35*a* of the intake pipe 30 and the bypass 35 at the inlet thereof. Exhaust gas of the engine 1 is discharged through the exhaust port 11, an exhaust pipe 12 having a catalytic converter 13, an exhaust chamber 14 and a muffler 15.

The scavenge pump 33 is operatively connected to the crankshaft 5 through a transmitting device 37 comprising an endless belt running over a crank pulley and a pump pulley. The scavenge pump 33 is driven by the crankshaft 5 through the transmitting device 37 for producing the scavenge pressure. An accelerator pedal 40 is operatively connected with the control valve 36 through a valve controller 41. A opening degree of the control valve 36 is controlled by the controller 41 so as to be inversely proportional to a depressing degree of the accelerator pedal 40.

The engine brake control valve 25 is operatively connected to an actuator 26 which is supplied with vacuum generated by a vacuum generator 28 through a solenoid-operated three-way valve 27. The vacuum generator 28 is a vacuum source used for a master cylinder of the brake system.

Figure 2:
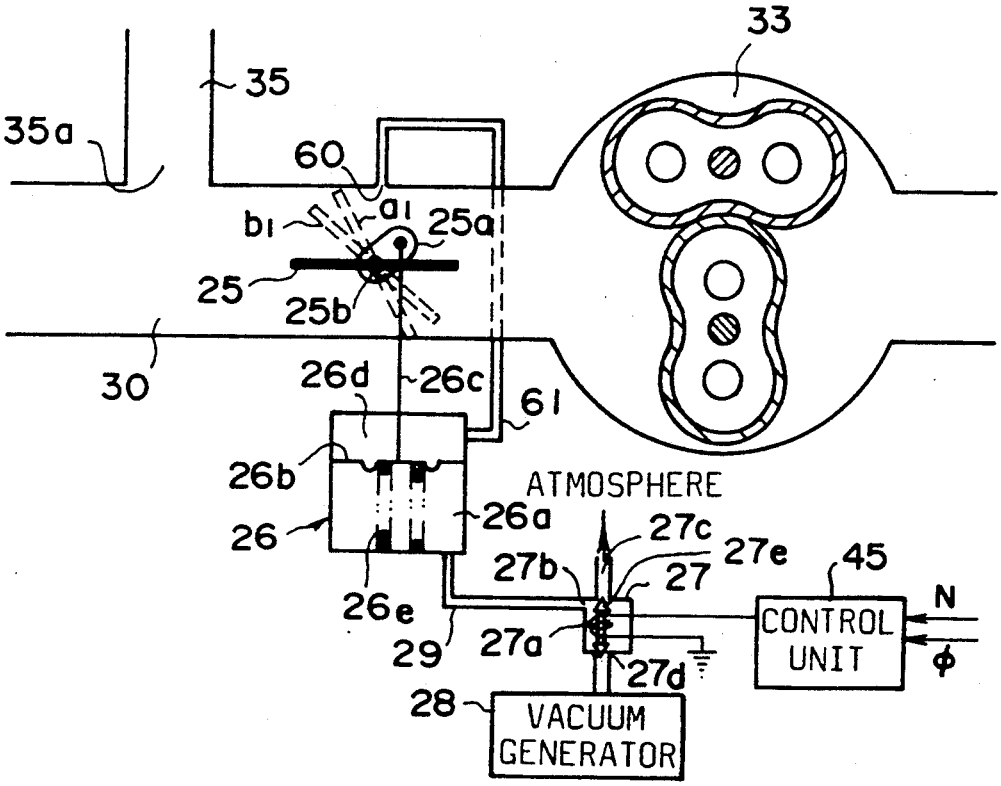
FIG. 2 is an enlarged schematic diagram showing an engine brake valve and an operating system according to the present invention.
Figure 3A:
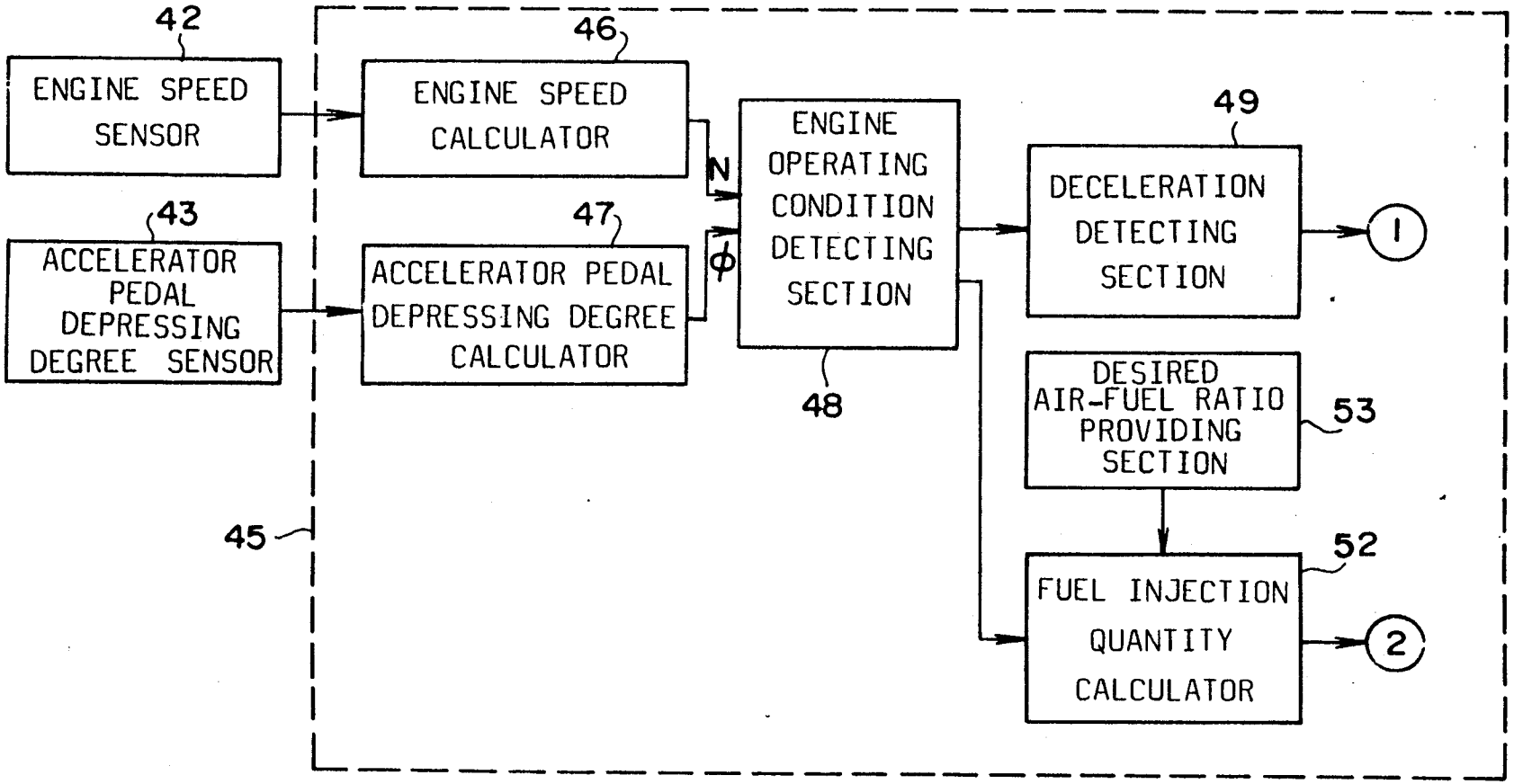
FIGS. 3*a* and 3*b* show a block diagram of a control unit according to the present invention.
Figure 3B:
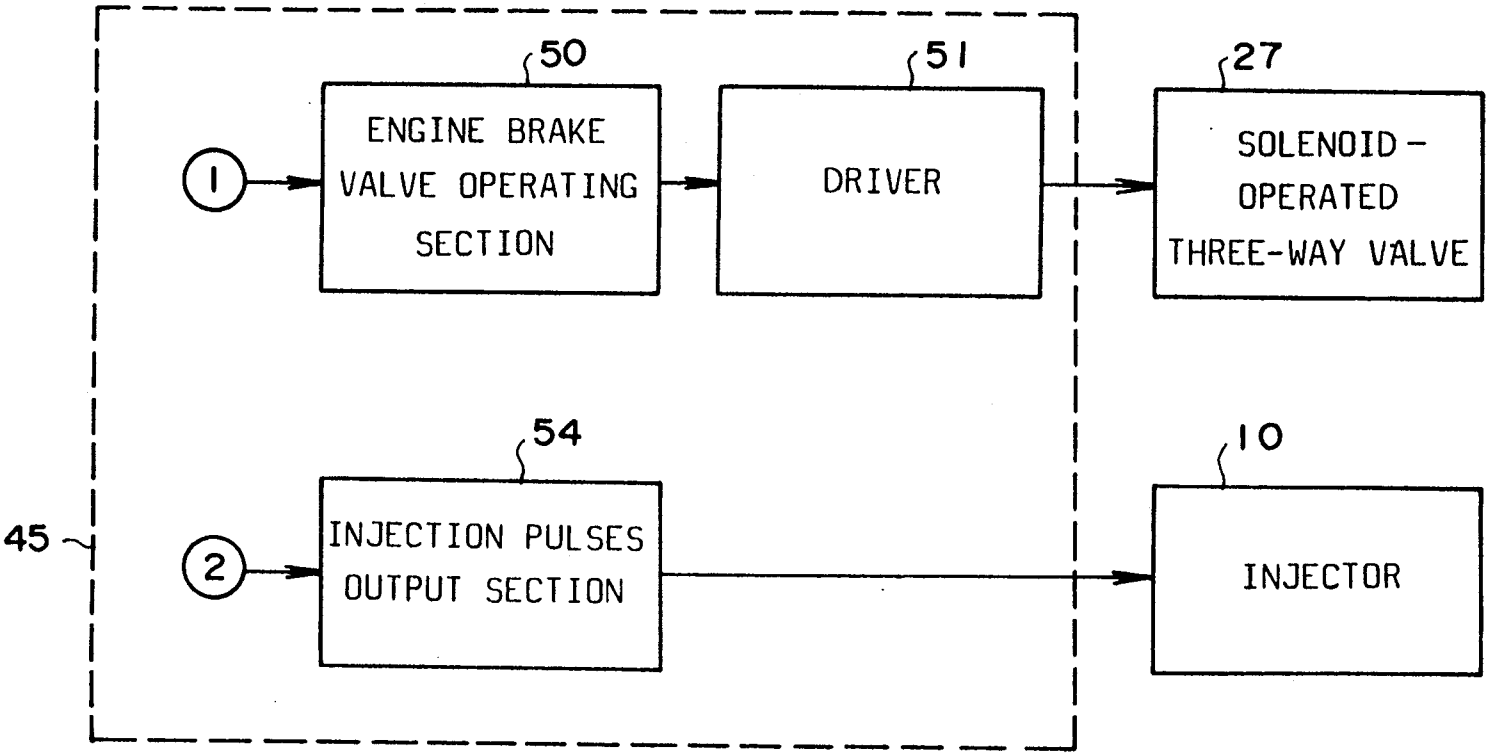

Referring to FIG. 2, the actuator 26 comprises a diaphragm **26*b* defining a vacuum chamber 26*a* and a pressure regulator chamber 26*d*. A coil spring 26*e* is provided in the vacuum chamber 26*a* for urging the diaphragm 26*b* toward the pressure regulator chamber 26*d*. An actuating rod 26*c* is connected between an arm 25*a* and the diaphragm 26*b*. The arm 25*a* is secured to a pivot 25*b* on which the engine brake control valve 25 is securely mounted. The arm 25*a* pivots in accordance with reciprocal movement of the rod 26*c*, thereby pivoting the control valve 25. The pressure regulator chamber 26*d* of the actuator 26 is communicated with the intake pipe 30 through a vacuum passage 61 and a vacuum port 60 provided downstream of a swinging end of the engine brake control valve 25. The vacuum at the port 60 is supplied to the pressure regulator chamber 26*d* to deflect the diaphragm 26*b*** accordingly.

The three-way valve 27 comprises a vacuum port **27*d* connected to the vacuum generator 28, an atmospheric port 27*c* communicated with atmosphere, an actuator port 27*b* communicated with the vacuum chamber 26*a* of the actuator 26 through a vacuum passage 29, a valve stem 27*e* and a solenoid 27*a*. The valve stem 27*e* is shifted by the solenoid 27*a* so as to selectively open the vacuum port 27*c* and the atmosphere port 27*c***.

Further, an engine speed sensor 42 and an accelerator pedal depressing degree sensor 43 are provided for determining engine operating conditions and conditions for engine braking. Output signals from the sensors 42 and 43 are supplied to a control unit 45 which feeds an ignition signal to the spark plug 9, a fuel injection pulse signal to the injector 10, and an engine brake signal to the solenoid-operated three-way valve 27 to close the engine brake control valve 25 at engine braking.

Referring to FIGS. **3*a* and 3*b*, the control unit 45 comprises an engine speed calculator 46 to which the output signal of the engine speed sensor 42 is fed, and an accelerator pedal depressing degree calculator 47 to which the output signal of the accelerator pedal depressing degree sensor 43 is fed. An engine speed N calculated in the calculator 46 and an accelerator pedal depressing degree $\phi$ calculated in the calculator 47 are applied to an engine operating condition detecting section 48. An output signal of the detecting section 48 is fed to a fuel injection quantity calculator 52. I the fuel injection quantity calculator 52, a fuel injection quantity is calculated in dependency on a desired air-fuel ratio (stoichiometry) stored in a table in a desired air-fuel ratio providing section 53. The fuel quantity is fed to an injection pulse output section 54 where a fuel injection pulse width corresponding to the fuel quantity is determined. The output section 54 applies a fuel injection pulse signal to the injector 10** to inject the fuel.

The control unit 45 is further provided with a deceleration detection section 49 to which the output signal of the engine operating condition detecting section 48 is applied. The detecting section 49 produces a deceleration signal representing the deceleration of the vehicle when the accelerator pedal depressing degree $\phi$ become zero while the engine speed N is higher than a predetermined engine speed $N_O$. The deceleration signal is further applied to an engine brake valve operating section 50 which produces an engine brake valve closing signal. The engine brake valve closing signal is applied to the solenoid **27*a* of the three-way valve 27 through a driver 51**.

The operation of the two-cycle engine is described hereinafter.

The air supplied from the scavenge pump 33 and cooled at the intercooler 32 is returned to the inlet side of the scavenge pump 33 through the bypass 35. Since the opening degree of the control valve 36 is controlled to be inversely proportional to the depressing degree $\phi$ of the accelerator pedal 40, when the depressing degree $\phi$ of the accelerator pedal 40 is small, the control valve 36 is largely opened. As a result, a large amount of the air is returned to the inlet side of the scavenge pump 33. Thus, a small amount of the air corresponding to the small accelerator pedal depressing degree $\phi$ flows into the cylinder 2 for scavenging without causing pumping loss. As the depressing degree $\phi$ increases, the quantity of fresh air forced into the cylinder 2 increases with a decrease of the opening degree of the control valve 36.

When the piston 3 reaches a position close to the bottom dead center as shown in FIG. 1, the scavenge port 16 opens as well as the exhaust port 11 so that intake air, quantity of which depends on the position of the accelerator pedal 40, is delivered by the scavenge pump 33 into the cylinder 2 through the intercooler 32 and the scavenge port 16. Consequently, burned gas in the cylinder 2 is scavenged so that fresh intake air is admitted therein in a short time. During the compression stroke the piston 3 goes up, closing both ports 11 and 16. The fuel injected from the injector 10 in accordance with the fuel injection pulse signal from the control unit 45 is injected at a high pressure to form a combustible mixture in the chamber 8. The mixture is swirling in the combustion chamber with the scavenging air and ignited by the spark plug 9 immediately before the top dead center. The fuel is injected at an appropriate timing and pulse width so that rich air-fuel mixture is formed adjacent the spark plug 9. Hence a stratified charge is achieved. After explosion, the piston 3 descends for the power stroke. Accordingly, the exhaust port 11 is opened so that the burned gas in the cylinder 2 which is still under high pressure escapes. The piston 3 further descends, thereby returning to the aforedescribed intake stroke where the cylinder 2 is scavenged.

In the control unit 45, the engine speed N and the accelerator pedal depressing degree $\phi$ calculated by the engine speed calculator 46 and the accelerator pedal depressing degree calculator 47, respectively, are fed to the engine operating condition detecting section 48 to detect the engine operating conditions. The desired air-fuel ratio which are obtained in accordance with the engine operating conditions from the desired air-fuel ratio providing section 53, is applied to the fuel injection quantity calculator 52 so that the fuel injection quantity dependent on the engine operating conditions is calculated. A fuel injection pulse width signal representing the quantity is fed to the injector 10 through the injection pulses output section 54 so that quantity of the fuel corresponding to each pulse width signal is injected from the injector 10. Thus, the combustible mixture is maintained at the desired air-fuel ratio.

Figure 4:
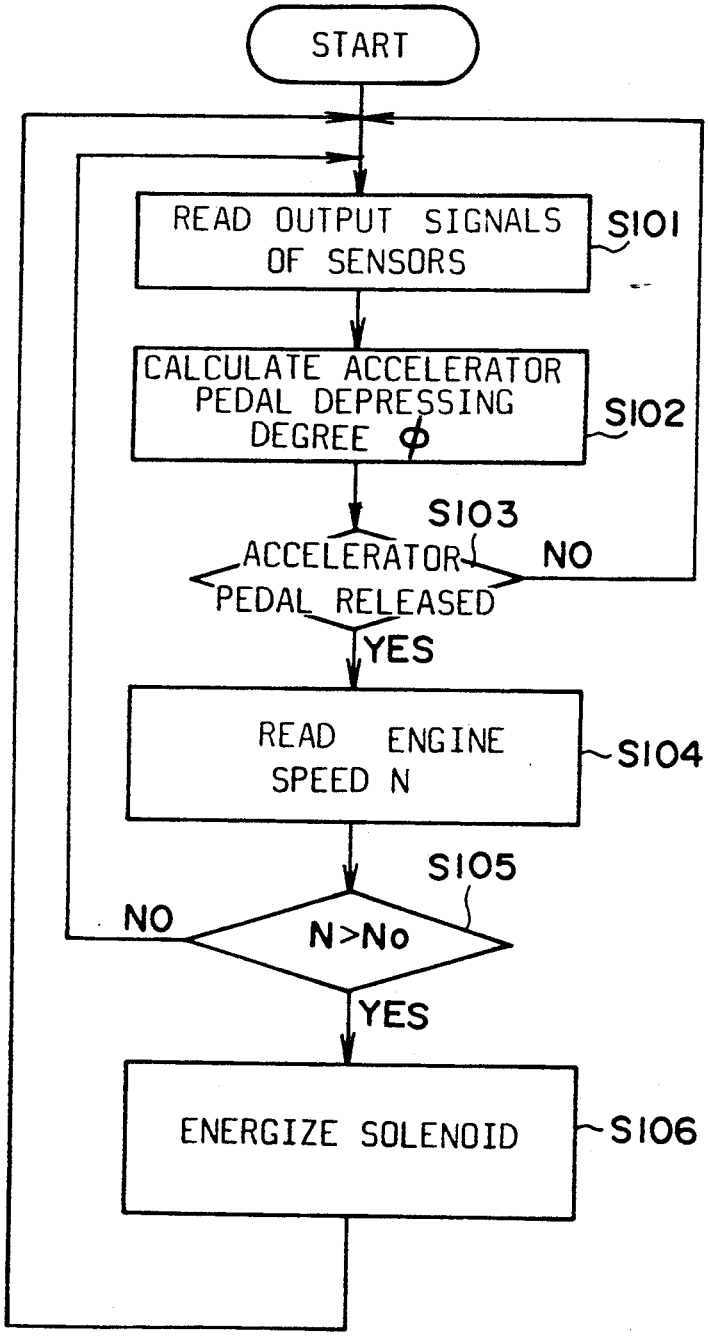
FIG. 4 is a flowchart showing an operation of the control system.

The operation of the engine brake system of the present invention is described hereinafter with reference to the flowchart shown in FIG. 4.

At a step S101, the output signals of the engine speed sensor 42 and the accelerator pedal depressing degree sensor 43 are read. At a step S102, the accelerator pedal depressing degree $\phi$ is calculated and at a step S103, it is determined whether the accelerator pedal is released by referring the accelerator pedal depressing degree $\phi$. When the accelerator pedal is released, the program goes to a step S104 where the engine speed N is read. At a step S105, it is determined whether the engine speed N is higher than the predetermined reference speed $N_O$. If the engine speed N is higher than $N_O$, the solenoid 27*a* of the solenoid-operated three-way valve 27 is energized at a step Sl06 to effect the engine braking.

More particularly, upon energization of the solenoid 27*a*, the valve stem 27*e* is shifted to open the vacuum port 27*d* and to close the atmosphere port 27*c*. Thus, the vacuum in the vacuum generator 28 is supplied to the vacuum chamber 26*a* of the actuator 26 passing through the actuator port 27*b* and the vacuum passage 29 so that the diaphragm 26*b* is downwardly deflected against urging force of the coil spring 26*e*. Therefore, the actuating rod 26*c* is pulled by the diaphragm 26*b* to pivot the arm 25*a* and the engine brake valve 25 as shown by a phantom line $a_1$. Consequently, vacuum is generated in the intake pipe 30 between the scavenge pump 33 and the engine brake valve 25. The vacuum at the port 60 is supplied to the pressure regulator chamber 26*d* of the actuator 26 through the passage 61 to upwardly urge the diaphragm 26*b*. Consequently the diaphragm 26*b* is kept at a position where pressures in both chambers 26*a* and 26*d* balance with each other. As a result, the diaphragm 26*b* is upwardly deflected, so that the arm 25*a* is pivoted in the counterclockwise direction. Thus, the engine brake valve 25 is slightly opened to a position shown by a line $b_1$. The pressure at the port 60 is maintained substially constant irrespective of the engine speed, so that the valve 25 is kept at the position $b_1$. Since the scavenge pump 33 is connected to the crankshaft 5 of the engine 1, the load on the engine increases because of the closing of the valve 25, thereby increasing the engine braking effect.

Figure 5:
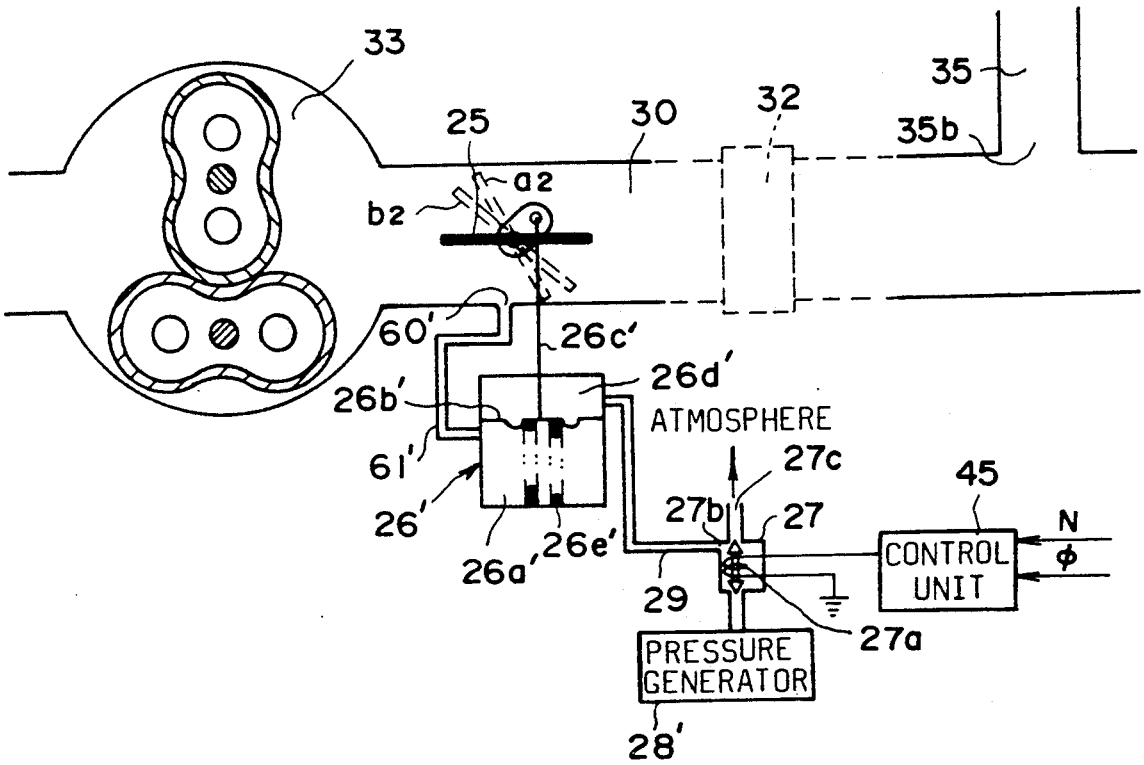
FIG. 5 is a schematic diagram showing an engine brake valve according to a second embodiment of the present invention.

FIG. 5 shows the second embodiment of the present invention. The same numerals as those in FIG. 2 designate the same parts in FIG. 5. In the embodiment, the engine brake valve 25 is disposed in the intake pipe 30 between the scavenge pump 33 and the intercooler 32. The valve 25 is operated by a valve actuator 26' having a pressure chamber 26*d*', a pressure regulator chamber 26*a*', a diaphragm 26*b*', actuator rod 26*c*' connected to the diaphragm 26*b*' and the valve 25, and a spring 26*e*'. The pressure chamber 26*d*' is communicated with a positive pressure generator 28', such as a master valve, through the solenoid-operated three-way valve 27. The pressure regulator chamber 26*a*' is communicated with the intake pipe 30 through a pressure passage 61' and a positive pressure port 60' provided upstream of a swinging end of the closed engine brake valve 25.

At a deceleration, the control unit 45 applies the engine brake valve closing signal to the solenoid 27*a* of the three-way valve 27 as described in the first embodiment. The pressure from the pressure generator 28' is applied to the pressure chamber 26*d*' through the solenoid-operated three-way valve 27 and the passage 29 to deflect the diaphragm 26*b*' against the spring 26*e*'. The actuating rod 26*c*' is accordingly shifted to pivot the valve 25 to a closing position shown by a phantom line $a_2$. Therefore the pressure in the inlet pipe 30 between the scavenge pump 33 and the engine brake valve 25 increases, thereby increasing the engine braking effect. The pressure is kept substantially constant by slightly opening the valve 25 to a position $b_2$ in the same manner as in the first embodiment.

In accordance with the present invention, there is provided an engine brake system for a two-cycle engine with a scavenge pump. In addition, the pressure in the intake pipe between the scavenge pipe and the engine brake valve is maintained substantially constant to keep the engine brake valve at a constant position, thereby provide a reliable engine braking effect.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. An engine brake system of a two-cycle engine for a motor vehicle, the engine having at least one cylinder, a scavenge port, an intake passage communicated with said scavenge port, and a scavenge pump provided in said intake passage and driven by a crankshaft of the engine for supplying intake air to the cylinder, the system comprising:

an engine brake valve provided in said intake passage adjacent said scavenge pump;

an actuator for operating said engine brake valve;

detector means for detecting deceleration of the vehicle and for producing a deceleration signal;

means responsive to the deceleration signal for operating said actuator for closing said engine brake valve so as to increase load on the engine.

2. The system according to claim 1, wherein the detector means produces said deceleration signal when deceleration of the vehicle is detected at a higher engine speed than a set speed.

3. The system according to claim 1, wherein said actuator has a diaphragm operated by a pressure applied to one side thereof from the intake passage adjacent said engine brake valve.

4. The system according to claim 3, wherein said actuator is arranged such that said diaphragm is kept at a position where said pressure balances with another pressure applied to the other side thereof.

5. The system according to claim 3, wherein said engine brake valve is disposed downstream of said scavenge pump.

6. The system according to claim 3, wherein said engine brake valve is disposed upstream of said scavenge pump.

* * * * *